US007670443B2

(12) United States Patent
Kogure et al.

(10) Patent No.: US 7,670,443 B2
(45) **Date of Patent: *Mar. 2, 2010**

(54) MAGNETIC ALLOY MATERIAL AND METHOD OF MAKING THE MAGNETIC ALLOY MATERIAL

(75) Inventors: Ryosuke Kogure, Mishima-gun (JP); Hirokazu Kanekiyo, Kyoto (JP); Takeshi Nishiuchi, Ibaraki (JP); Satoshi Hirosawa, Otsu (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/673,729

(22) Filed: Feb. 12, 2007

(65) Prior Publication Data

US 2007/0137732 A1 Jun. 21, 2007

Related U.S. Application Data

(63) Continuation of application No. 10/642,276, filed on Aug. 18, 2003, now Pat. No. 7,186,303.

(30) Foreign Application Priority Data

Aug. 21, 2002 (JP) ..... 2002-240113

(51) Int. Cl.
*H01F 1/053* (2006.01)

(52) U.S. Cl. ..... 148/301; 148/307

(58) Field of Classification Search ..... None
See application file for complete search history.

(56) References Cited

U.S. PATENT DOCUMENTS 4,529,445 A * 7/1985 Buschow ..... 420/19
4,582,535 A 4/1986 Buschow
4,889,607 A 12/1989 Buschow
6,826,915 B2 12/2004 Wada et al.
2004/0079446 A1 4/2004 Kogure et al.
2004/0194855 A1 10/2004 Fukamichi et al.

FOREIGN PATENT DOCUMENTS

JP 2000-054086 A 2/2000
JP 2002-069596 A 3/2002
JP 2003-028532 A 1/2003

OTHER PUBLICATIONS

Asaya Fujita et al., "Huge Magnetovolume Effect and Magnetocaloric Effect of Itinerant Electron Meta-magnetic La (FexSi1-x)13 Compound", Materia, vol. 41, No. 4, pp. 269-275, 2002.

* cited by examiner

*Primary Examiner*—John P. Sheehan
(74) *Attorney, Agent, or Firm*—Keating & Bennett, LLP

(57) ABSTRACT

A method of making a magnetic alloy material includes the steps of: preparing a melt of an alloy material having a predetermined composition; rapidly cooling and solidifying the melt to obtain a rapidly solidified alloy represented by: $Fe_{100-a-b-c}RE_aA_bTM_c$ where RE is at least one rare-earth element selected from La, Ce, Pr, Nd, Pm, Sm, Eu, Gd, Tb, Dy, Ho, Er and Tm and including at least about 90 at % of La; A is at least one element selected from Al, Si, Ga, Ge and Sn; TM is at least one transition metal element selected from Sc, Ti, V, Cr, Mn, Co, Ni, Cu and Zn; and 5 at %≦a≦10 at %, 4.7 at %≦b≦18 at % and 0 at %≦c≦9 at %; and producing a compound phase having an $NaZn_{13}$-type crystal structure in at least about 70 vol % of the rapidly solidified alloy.

3 Claims, 9 Drawing Sheets

MAGNETIC ALLOY MATERIAL AND METHOD OF MAKING THE MAGNETIC ALLOY MATERIAL

BACKGROUND OF THE INVENTION

1. Field of the Invention

The present invention relates to a magnetic alloy material that can be used effectively as a magnetic refrigerant material or a magnetostrictive material and also relates to a method of making such a magnetic alloy material.

2. Description of the Related Art

A magnetic alloy, having a composition represented by the general formula: $La_{1-z}RE_z(F_{1-x}A_{x-y}TM_y)_{13}$ (where A is at least one element that is selected from the group consisting of Al, Si, Ga, Ge and Sn; TM is at least one of the transition metal elements; RE is at least one of the rare-earth elements except La; and the mole fractions x, y and z satisfy $0.05 \leqq x \leqq 0.2$, $0 \leqq y \leqq 0.1$ and $0 \leqq z \leqq 0.1$, respectively, and which will be referred to herein as an "$LaFe_{13}$-based magnetic alloy") has an $NaZn_{13}$-type crystal structure and exhibits giant magnetocaloric effect and magnetovolume effect at temperatures around its Curie temperature Tc. Thus, the $LaFe_{13}$-based magnetic alloy is recently expected to be applicable for use as a magnetic refrigerant material or as a magnetostrictive material (see Japanese Laid-Open Publication No. 2000-54086, Japanese Laid-Open Publication No. 2002-69596 and Asaya Fujita et al., "Huge Magnetovolume Effect and Magnetocaloric Effect of Itinerant Electron Meta-magnetic $La(Fe_xSi_{1-x})_{13}$ Compound", Materia, Vol. 41, No. 4, pp. 269-275, 2002, for example).

In the prior art, the $LaFe_{13}$-based magnetic alloy is produced by thermally treating a cast alloy, obtained by an arc melting or high frequency melting process, at about 1,050° C. for approximately 168 hours within a vacuum.

The conventional method of making the $LaFe_{13}$-based magnetic alloy, however, has the following drawbacks.

Specifically, the cast alloy, obtained from a molten alloy having a predetermined composition, has a structure in which at least two crystalline phases with excessively large grain sizes, including an α-Fe phase (as a solid solution of portions of A and TM in the general formula described above) and a phase consisting of the balance, are distributed in a complex pattern as shown in FIG. 6A. A compound phase having the $NaZn_{13}$-type crystal structure (which will be referred to herein as an "$LaFe_{13}$-type compound phase") is produced on the interface between these crystalline phases with excessively large grain sizes as shown in FIG. 6B. Thus, to obtain the $LaFe_{13}$-based magnetic alloy (as an intermetallic compound) from a structure including such crystalline phases with excessively large grain sizes by the conventional process, the cast alloy should be homogenized by being thermally treated at an elevated temperature for a long time (which will be sometimes referred to herein as a "homogenizing heat treatment") as described above. The conventional $LaFe_{13}$-based magnetic alloy cannot be mass-produced sufficiently because such a homogenizing heat treatment must be carried out for a long time to obtain the $LaFe_{13}$-based magnetic alloy.

In addition, while the cast alloy is processed by the long homogenizing heat treatment, the surface of the alloy may be corroded due to oxidation, thus possibly deteriorating the magnetocaloric effect or magnetovolume effect of the resultant $LaFe_{13}$-based magnetic alloy.

Furthermore, the cast alloy normally has an ingot shape and is usually subjected to the homogenizing heat treatment as it is (i.e., without being pulverized). However, a magnetic refrigerant material is often used as powder particles to achieve higher heat exchange efficiency with respect to a heat exchange fluid (e.g., a liquid with huge specific heat such as an aqueous antifreeze). Thus, the ingot cast alloy is not so easy to pulverize and may decrease the productivity unintentionally.

SUMMARY OF THE INVENTION

In order to overcome the problems described above, preferred embodiments of the present invention provide a method of making the $LaFe_{13}$-based magnetic alloy material much more efficiently than the conventional process.

A method of making a magnetic alloy material according to a preferred embodiment of the present invention preferably includes the steps of: preparing a melt of an alloy material having a predetermined composition; rapidly cooling and solidifying the melt of the alloy material to obtain a rapidly solidified alloy having a composition represented by the general formula: $Fe_{100-a-b-c}RE_aA_bTM_c$ where RE is at least one rare-earth element that is selected from the group consisting of La, Ce, Pr, Nd, Pm, Sm, Eu, Gd, Tb, Dy, Ho, Er and Tm and that includes at least about 90 at % of La; A is at least one element that is selected from the group consisting of Al, Si, Ga, Ge and Sn; TM is at least one transition metal element that is selected from the group consisting of Sc, Ti, V, Cr, Mn, Co, Ni, Cu and Zn; and mole fractions a, b and c satisfy 5 at $\% \leqq a \leqq 10$ at %, 4.7 at $\% \leqq b \leqq 18$ at % and 0 at $\% \leqq c \leqq 9$ at %, respectively; and producing a compound phase having an $NaZn_{13}$-type crystal structure in at least about 70 vol % of the rapidly solidified alloy.

In one preferred embodiment of the present invention, the step of producing the compound phase preferably includes the step of thermally treating the rapidly solidified alloy at a temperature of about 400° C. to about 1,200° C. for a period of time of about 1 second to about 100 hours.

In this particular preferred embodiment, the step of thermally treating preferably includes the step of thermally treating the rapidly solidified alloy for at least about 10 minutes.

In another preferred embodiment, the step of thermally treating preferably includes the step of producing a homogenous $NaZn_{13}$-type crystal structure in the overall rapidly solidified alloy.

In still another preferred embodiment, the step of rapidly cooling and solidifying the melt preferably immediately produces the compound phase having the $NaZn_{13}$-type crystal structure.

In yet another preferred embodiment, the step of rapidly cooling and solidifying the melt preferably includes the step of rapidly cooling and solidifying the melt at a cooling rate of about $1\times10^{2}$° C./s to about $1\times10^{8}$° C./s.

In yet another preferred embodiment, the step of rapidly cooling and solidifying the melt preferably produces a thin-strip rapidly solidified alloy having a thickness of about 10 μm to about 300 μm.

In yet another preferred embodiment, the magnetic alloy material preferably exhibits a magnetocaloric effect.

In yet another preferred embodiment, the method preferably further includes the step of pulverizing the rapidly solidified alloy.

In yet another preferred embodiment, the magnetic alloy material preferably has a Curie temperature Tc of about 180 K to about 330 K to represent a magnetic phase transition.

In yet another preferred embodiment, the step of rapidly cooling and solidifying the melt preferably includes the step of obtaining a rapidly solidified alloy including Co as TM. By using Co as TM in the general formula described above and by controlling the mole fraction of Co, multiple magnetic alloy materials, having mutually different Curie temperatures Tc, can be obtained.

In yet another preferred embodiment, a temperature range in which the magnetic phase transition occurs preferably has a half width Δ Tc of at least about 30 K.

A magnetic alloy material according to a preferred embodiment of the present invention is preferably made by the method according to any of various preferred embodiments of the present invention described above, and can be used particularly effectively as a magnetic refrigerant material.

Various preferred embodiments of the present invention described above provide a method of making an $LaFe_{13}$-based magnetic alloy material much more efficiently than the conventional process. In particular, by adopting the process of forming a thin-strip rapidly solidified alloy, the rapidly solidified alloy can be pulverized easily. Thus, the magnetic alloy material can be produced highly efficiently as a magnetic refrigerant material that is used as powder particles.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1A:
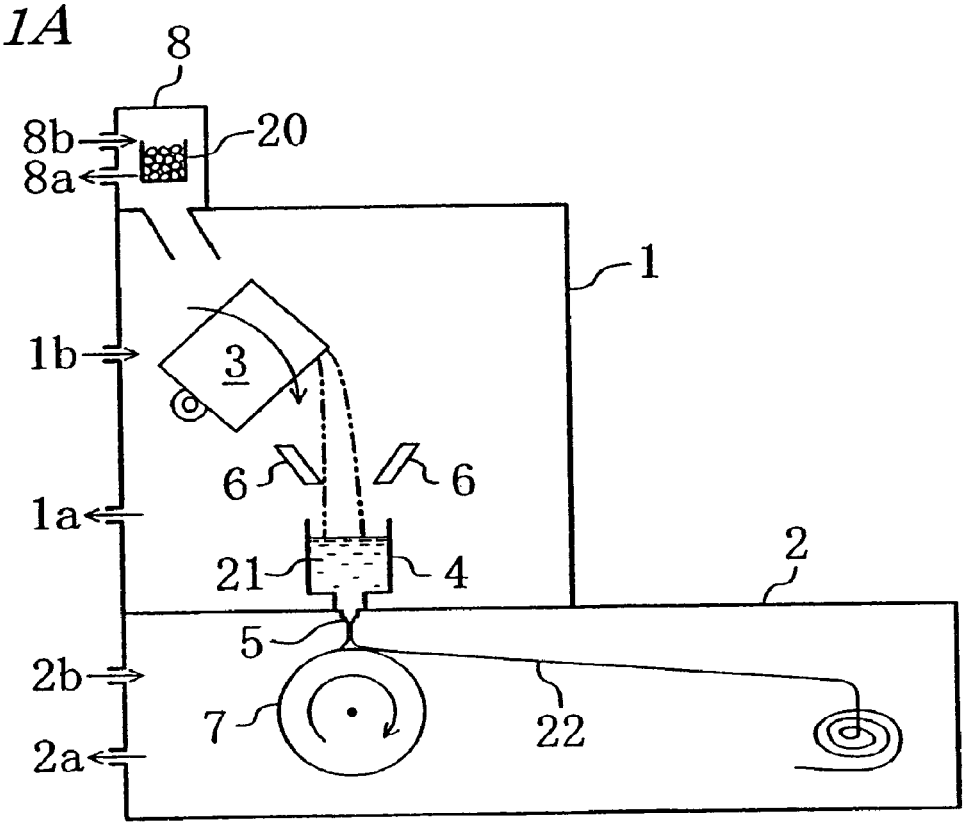
FIG. 1A is a cross-sectional view illustrating an overall arrangement of a machine for use to make a rapidly solidified alloy according to a preferred embodiment of the present invention.

Hereinafter, preferred embodiments of a method of making a magnetic alloy material (e.g., an $LaFe_{13}$-based magnetic alloy) according to the present invention will be described.

A method of making a magnetic alloy material according to a preferred embodiment of the present invention preferably includes the steps of: preparing a melt of an alloy material having a predetermined composition; rapidly cooling and solidifying the melt of the alloy material to obtain a rapidly solidified alloy having a composition represented by the general formula: $Fe_{100-a-b-c}RE_aA_bTM_c$, where RE is at least one rare-earth element that is selected from the group consisting of La, Ce, Pr, Nd, Pm, Sm, Eu, Gd, Tb, Dy, Ho, Er and Tm and that includes at least about 90 at % of La; A is at least one element that is selected from the group consisting of Al, Si, Ga, Ge and Sn; TM is at least one transition metal element that is selected from the group consisting of Sc, Ti, V, Cr, Mn, Co, Ni, Cu and Zn; and mole fractions a, b and c satisfy 5 at %≦a≦10 at %, 4.7 at %≦b≦18 at % and 0 at %≦c≦9 at %, respectively; and producing a compound phase having an $NaZn_{13}$-type crystal structure (i.e., an $LaFe_{13}$-type compound phase) in at least about 70 vol % of the rapidly solidified alloy. These manufacturing process steps of preparing a melt, rapidly cooling and solidifying the melt, and producing a compound phase will be referred to herein as first, second and third manufacturing process steps, respectively, for convenience sake.

A method of making an $LaFe_{13}$-based magnetic alloy according to a preferred embodiment of the present invention adopts a rapid cooling process (or melt-quenching process) as its second manufacturing process step. Generally speaking, a rapidly solidified alloy has a more uniform composition than a cast alloy. Unlike a cast alloy, a rapidly solidified alloy has no multi-phase structure including crystalline phases with excessively large grain sizes (see FIG. 6A). For example, even if the rapidly solidified alloy is pulverized into particles with sizes of about 10 μm to about 300 μm, the $LaFe_{13}$-type compound phase may still account for at least about 70 vol % of each of those particles when the rapidly solidified alloy is thermally treated.

By adjusting the conditions of the heat treatment, for example, a magnetic alloy material, of which about 90 vol % or more is defined by the $LaFe_{13}$-type compound phase, can be naturally obtained. It should be noted that if the mole fraction a is out of the preferred range defined above, then the $LaFe_{13}$-type compound phase will be short of about 70 vol % of each particle. Also, if the mole fraction b is less than about 4.7 at %, then no $LaFe_{13}$-type compound phase can be formed. However, if the mole fraction b exceeds about 18 at %, then the magnetocaloric effect (or magnetovolume effect) is not achieved sufficiently. Likewise, if the mole fraction c is out of its preferred range, the magnetocaloric effect (or magnetovolume effect) is not achieved sufficiently, either, and the resultant magnetic alloy material cannot be used as a magnetic refrigerant material (or magnetostrictive material) effectively enough.

The third manufacturing process step typically includes the step of thermally treating the rapidly solidified alloy, obtained by the second manufacturing process step, at a temperature of about 400° C. to about 1,200° C. for a period of time of about 1 second to about 100 hours. The rapidly solidified alloy obtained by the second manufacturing process step has a more homogeneous structure than a cast alloy. Thus, the overall rapidly solidified alloy can be turned into the $LaFe_{13}$-based magnetic alloy by conducting the heat treatment in a shorter time. For example, the heat treatment time may be about 24 hours or less and can be as short as about 5 minutes. It should be noted that to improve the magnetic properties, the alloy preferably consists essentially of the $LaFe_{13}$-type compound phase having a homogeneous structure. And to turn the overall alloy into the $LaFe_{13}$-type compound phase with the homogeneous structure, the alloy is preferably thermally treated for at least about 10 minutes. As will be described later, as for a rapidly solidified alloy obtained by adjusting the roller surface velocity to the range of about 3 m/s to about 30 m/s, for example, almost the entire alloy can be turned into the $LaFe_{13}$-type compound phase with a homogeneous structure when thermally treated for about 10 minutes at least. However, the heat treatment time should not exceed about 90 minutes, because the percentage of the α-Fe phase would increase excessively if the alloy was thermally treated for more than about 90 minutes.

The heat treatment temperature may be appropriately defined in combination with the heat treatment process time such that the desired $LaFe_{13}$-based magnetic alloy can be obtained. However, the heat treatment temperature should not be lower than about 400° C., because the process time would exceed about 100 hours at such a low heat treatment temperature. Nevertheless, the heat treatment temperature should not be higher than about 1,200° C., either, because the surface would deteriorate significantly due to oxidation, for example, and a particular element would vaporize excessively at such a high heat treatment temperature. To shorten the heat treatment time to approximately one hour, the heat treatment is preferably carried out at a temperature of about 900° C. to about 1,200° C. Also, to minimize the oxidation, the atmosphere is preferably either a vacuum (of about $10^{-2}$ Pa or less, for example) or an inert gas (e.g., a rare gas, in particular).

In the method of making the $LaFe_{13}$-based magnetic alloy according to preferred embodiments of the present invention, the first manufacturing process step thereof may be carried out as in the prior art.

In the manufacturing process according to this preferred embodiment of the present invention, the heat treatment time can be shortened and the productivity can be increased. In addition, deterioration (e.g., oxidation) on the surface of the $LaFe_{13}$-based magnetic alloy can also be minimized during the heat treatment process. Thus, the magnetic properties of the $LaFe_{13}$-based magnetic alloy hardly deteriorate, either. For example, surface layers (to a depth of several millimeters) of the conventional $LaFe_{13}$-based magnetic alloy, obtained by thermally treating a cast alloy for a long time, cannot be used as a magnetic refrigerant material. In contrast, the rapidly solidified alloy obtained by the method of this preferred embodiment of the present invention (more particularly, a thin-strip rapidly solidified alloy or an alloy ribbon) may be used as a magnetic refrigerant material as it is. Thus, according to this preferred embodiment of the present invention, the yield of the expensive material can be increased and the manufacturing cost can be decreased significantly. Also, as will be described later, the thin-strip rapidly solidified alloy can be pulverized much more easily than the cast alloy. As a result, the pulverization process can be finished in a much shorter time.

The $LaFe_{13}$-based magnetic alloy achieves a giant magnetocaloric effect or magnetovolume effect because most of the magnetic alloy exhibits a magnetic phase transition, which is similar to a first-order transition, at temperatures around its Curie temperature. In other words, to increase the magnetocaloric effect or magnetovolume effect, the percentage of the $LaFe_{13}$-type compound phase, exhibiting the magnetic phase transition similar to the first-order transition, is preferably increased as much as possible. In the conventional process, the $LaFe_{13}$-type compound phase is produced on the interface between an α-Fe phase and grain boundary phases with excessively large grain sizes, which are included in an as-cast alloy. Thus, the as-cast alloy needs to be homogenized for a long time.

Meanwhile, not just the casting process but also a rapid cooling process (or melt-quenching process) are known as methods of making an alloy. However, even when a rapid cooling process is adopted, the α-Fe phase is also produced as easily as in the casting process. In addition, the rapid cooling process may slightly vary the original composition or create unwanted metastable phases other than the $LaFe_{13}$-type compound phase. Thus, nobody has ever reported that the $LaFe_{13}$-based magnetic alloy could be produced successfully by a rapid cooling process.

However, the present inventors discovered via experiments that the rapid cooling process produced a highly homogeneous and fine structure as described above and that the as-cast alloy already included the $LaFe_{13}$-type compound phase as will be described in detail later by way of illustrative examples. Alternatively, the as-cast alloy may also have an amorphous structure and the $LaFe_{13}$-type compound phase may also be produced by a heat treatment process.

In the process step of making the rapidly solidified alloy, the cooling rate is preferably about $1\times10^{2\circ}$ C./s to about $1\times10^{8\circ}$ C./s. The reason is as follows. Specifically, if the cooling rate is lower than about $1\times10^{2\circ}$ C./s, then a multiphase structure, including an α-Fe phase with a relatively large grain size, is formed as in the conventional casting process. In that case, the homogenizing heat treatment must be carried out for more than 100 hours. On the other hand, if the cooling rate is higher than about $1\times10^{8\circ}$ C./s, then the resultant rapidly solidified alloy will have a decreased thickness and the productivity will drop unintentionally.

Examples of preferred rapid cooling processes that achieve such a cooling rate include a gas atomization process, a single roller process, a twin roller process, a strip casting process and a melt spinning process. Among other things, the melt spinning process and strip casting process are preferred, because a thin-strip rapidly solidified alloy with a thickness of about 20 μm to about 200 μm can be obtained highly efficiently by the melt spinning or strip casting process.

Figure 1B:
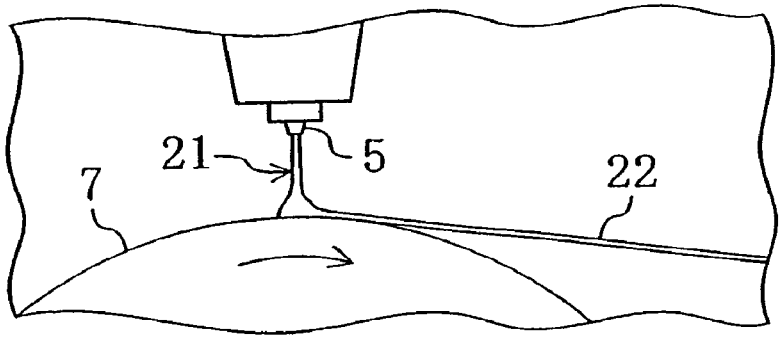
FIG. 1B illustrates a portion of the machine, where a melt is rapidly cooled and solidified, on a larger scale.

The rapidly solidified alloy may be obtained by performing a melt spinning process with a melt-quenching machine such as that shown in FIGS. 1A and 1B. The melt spinning process is preferably performed within an inert atmosphere to prevent the material alloy, which includes easily oxidizable rare-earth elements (i.e., La and RE in the general formula described above) and Fe, from being oxidized. The inert gas may be a rare gas of helium or argon or a nitrogen gas, for example. The rare gas of helium or argon is preferred to the nitrogen gas, because nitrogen reacts with the rare-earth elements relatively easily.

The machine shown in FIG. 1A includes material alloy melting and quenching chambers 1 and 2, in which a vacuum or an inert atmosphere is maintained at an adjustable pressure. Specifically, FIG. 1A illustrates an overall arrangement of the machine, while FIG. 1B illustrates a portion of the machine on a larger scale.

As shown in FIG. 1A, the melting chamber 1 includes: a melt crucible 3 to melt, at an elevated temperature, a material 20 that has been mixed to have a desired magnet alloy composition; a reservoir 4 with a teeming nozzle 5 at the bottom; and a mixed material feeder 8 to supply the mixed material into the melt crucible 3 while maintaining an airtight condition. The reservoir 4 stores the melt 21 of the material alloy therein and is provided with a heater (not shown) to maintain the temperature of the melt teemed therefrom at a predetermined level.

The quenching chamber 2 includes a rotating chill roller 7 for rapidly cooling and solidifying the melt 21 that has been dripped through the teeming nozzle 5.

In this machine, the atmosphere and pressure inside the melting and quenching chambers 1 and 2 are controllable within prescribed ranges. For that purpose, atmospheric gas inlet ports 1*b*, 2*b* and 8*b* and outlet ports 1*a*, 2*a*and 8*a*are provided at appropriate positions of the machine. In particular, the gas outlet port 2*a*is connected to a pump to control the absolute pressure inside the quenching chamber 2 within a range of about 30 kPa to the normal pressure (i.e., atmospheric pressure), preferably about 100 kPa or less. By changing the pressure inside of the melting chamber 1, the pressure on the melt being ejected through the nozzle 5 can be adjusted.

The melt crucible 3 may define a desired tilt angle to pour the melt 21 through a funnel 6 into the reservoir 4. The melt 21 is heated in the reservoir 4 by the heater (not shown).

The teeming nozzle 5 of the reservoir 4 is positioned on the boundary wall between the melting and quenching chambers 1 and 2 to drip the melt 21 in the reservoir 4 onto the surface of the chill roller 7, which is located under the nozzle 5. The orifice diameter of the teeming nozzle 5 may be about 0.5 mm to about 4.0 mm, for example. If the orifice diameter and/or the pressure difference (of about 10 kPa or more, for example) between the melting and quenching chambers 1 and 2 are adjusted according to the viscosity of the melt 21, the melt 21 can be teemed smoothly. The machine for use in this preferred embodiment can feed the molten alloy at a rate of about 1.5 kg/min to about 10 kg/min. If the feeding rate exceeded about 10 kg/min, then the resultant melt-quenching rate would be so low as to create a multi-phase structure unintentionally. More preferably, the molten alloy is fed at a rate of about 2 kg/min to about 8 kg/min.

The chill roller 7 is preferably made of Cu, Fe or an alloy including Cu or Fe. This is because if the chill roller was made of a material other than Cu or Fe, the resultant rapidly solidified alloy could not peel off the chill roller easily and might be wound around the roller. The chill roller 7 may have a diameter of about 300 mm to about 500 mm, for instance. The water-cooling capability of a water cooler, provided inside of the chill roller 7, is preferably calculated and adjusted based on the latent heat of solidification and the volume of the melt teemed per unit time.

First, the melt 21 of the material alloy having the predetermined composition is prepared and stored in the reservoir 4 of the melting chamber 1 shown in FIG. 1A. Next, the melt 21 is dripped through the teeming nozzle 5 onto the water-cooled roller 7 to contact with, and be rapidly cooled and solidified by, the chill roller 7 within a low-pressure Ar atmosphere. To obtain the uniform structure described above, the melt 21 is preferably cooled and solidified at a rate of about $1\times10^{2\circ}$ C./s to about $1\times10^{8\circ}$ C./s, more preferably about $1\times10^{2\circ}$ C./s to about $1\times10^{6\circ}$ C./s.

A period of time during which the melt 21 is quenched by the chill roller 7 is equivalent to an interval between a point in time the alloy contacts with the outer circumference of the rotating chill roller 7 and a point in time the alloy leaves the roller 7. In this period of time, the alloy has its temperature decreased to be a supercooled liquid. Thereafter, the supercooled alloy leaves the chill roller 7 and travels within the inert atmosphere. While the thin-strip alloy is traveling, the alloy has its heat dissipated into the atmospheric gas. As a result, the temperature of the alloy further drops. In this preferred embodiment, the pressure of the atmospheric gas is about 10 kPa to the atmospheric pressure.

In this preferred embodiment, the surface velocity of the roller is adjusted to the range of about 3 m/s to about 30 m/s and the pressure of the atmospheric gas is set to about 30 kPa or more to increase the secondary cooling effects caused by the atmospheric gas. In this manner, a thin-strip rapidly solidified alloy having a homogeneous structure can be obtained. A preferred roller surface velocity range is defined as such because if the roller surface velocity is lower than about 3 m/s, then the homogenizing heat treatment must be carried out for too long a time to prevent the surface of the resultant thin-strip rapidly solidified alloy from being deteriorated (e.g., corroded due to oxidation). However, if the roller surface velocity is higher than about 30 m/s, then the resultant thin-strip rapidly solidified alloy will be so thin that the homogeneous portion of the alloy, not including the surface deteriorated layer, may have an excessively low volume percentage.

According to preferred embodiments of the present invention, the molten alloy does not have to be rapidly cooled and solidified by the single roller method described above but may also be quenched by a strip casting process, which is a rapid cooling process that requires no flow rate control with the nozzle orifice. In the strip casting process, no nozzle orifice is used, and therefore, the melt feeding rate can be increased and stabilized easily. However, the atmospheric gas is often absorbed into the gap between the chill roller and the melt, thus possibly making the cooling rate non-uniform on the melt contact surface. To overcome these problems, the space in which the chill roller is provided should have its atmosphere pressure decreased to the range specified above such that the atmospheric gas will not be absorbed. Optionally, a gas atomization process may also be adopted although the productivity will somewhat decline in that case.

In the method of making an $LaFe_{13}$-based magnetic alloy according to a preferred embodiment of the present invention, a magnetic refrigerant material, exhibiting a magnetocaloric effect as represented by a magnetic entropy change $-\Delta S_{mag}$ of more than about 5 $JK^{-1}$ $kg^{-1}$ when the external field is changed from about 0 T to about 1 T, can be obtained. According to the manufacturing process described above, a thin-strip $LaFe_{13}$-based magnetic rapidly solidified alloy can be obtained, and therefore, a granular (or particulate) magnetic refrigerant material can be produced highly efficiently.

In a preferred embodiment of the present invention, an $LaFe_{13}$-based magnetic alloy, having a Curie temperature Tc of about 180 K (or about 190 K) to about 330 K to represent a magnetic phase transition, can be obtained. By using Co as TM in the general formula described above and by controlling the mole fraction of Co, multiple $LaFe_{13}$-based magnetic alloys with mutually different Curie temperatures Tc can be obtained. If the mole fraction of Co (i.e., the mole fraction c in the general formula described above) is about 9 at %, then Tc=330 K. It should be noted that the "magnetic phase transition" means herein a transition from a ferromagnetic phase into a paramagnetic phase, a transition from a ferromagnetic phase into an antiferromagnetic phase, or a transition from an antiferromagnetic phase into a paramagnetic phase.

In another preferred embodiment of the present invention, an $LaFe_{13}$-based magnetic alloy, causing the magnetic phase transition in a relatively broad temperature range and having a half width Δ Tc of about 30 K or more in the transition temperature range, can be obtained. Thus, according to this preferred embodiment, even if the single $LaFe_{13}$-based magnetic alloy is used as a magnetic refrigerant material, a magnetic refrigerator can still be provided. It is naturally possible to use multiple $LaFe_{13}$-based magnetic alloys with mutually different compositions (i.e., mutually different Curie temperatures Tc) according to the operating temperature range. Even so, the same operating temperature range can be covered by using a fewer types of alloys than an MnAs-based magnetic refrigerant material as disclosed in Japanese Laid- Open Publication No. 2003-028532. The regenerator and magnetic refrigerator as disclosed in Japanese Laid-Open Publication No. 2003-028532 may be naturally made of the $LaFe_{13}$-based magnetic alloy of this preferred embodiment.

An $LaFe_{13}$-based magnetic alloy according to any of various preferred embodiments of the present invention can be used particularly effectively as a magnetic refrigerant material. However, the $LaFe_{13}$-based magnetic alloy may also be used effectively as a magnetostrictive material as disclosed in Japanese Laid-Open Publication No. 2000-54086 or Japanese Laid-Open Publication No. 2002-69596, for example.

Hereinafter, specific methods of making an $LaFe_{13}$-based magnetic alloy according to preferred embodiments of the present invention will be described by way of experimental examples. It should be noted, however, that the present invention is in no way limited to the following specific examples.

EXPERIMENTAL EXAMPLE NO. 1

[Molten Material Alloy Preparing Process Step]

First, respective materials La, Fe and Si in predetermined amounts were mixed together such that an $LaFe_{13}$-type compound phase having a composition $La(Fe_{0.88}Si_{0.12})_{13}$ could be obtained. Then, the mixture was melted in a high frequency melting crucible, thereby obtaining a cast alloy. The cast alloy obtained in this manufacturing process step will be referred to herein as "Sample (e)".

[Rapid Cooling Process Step]

Using an experimental machine having the same configuration as that shown in FIG. 1A, a melt of about 10 g of an ingot cast alloy was ejected through a quartz nozzle with a diameter of about 0.8 mm onto a Cu roller that was rotating at a velocity of about 20 m/s, thereby obtaining an alloy ribbon. The alloy ribbon obtained in this process step will be referred to herein as "Sample (a)".

[Heat Treatment Process Step]

Sample (a) was wrapped in an Nb foil, introduced into a quartz tube and then thermally treated at about 1,000° C. for approximately one hour while evacuating the quartz tube to a vacuum of substantially 10 Pa or less with a rotary pump. The rapidly solidified alloy obtained in this manner will be referred to herein as "Sample (b)".

On the other hand, Sample (a) was also introduced airtight into a quartz tube that had been evacuated to a vacuum of about 10-2 Pa or less, and then thermally treated at about 1,050° C. for approximately 24 hours. The rapidly solidified alloy obtained in this manner will be referred to herein as "Sample (c)". Furthermore, Sample (a) was also introduced airtight into the same quartz tube, and then thermally treated at the same temperature but for approximately 120 hours. The rapidly solidified alloy obtained in this manner will be referred to herein as "Sample (d)".

About 10 g of Sample (e) (i.e., the cast alloy) was introduced airtight into a quartz tube that had been evacuated to a vacuum of about $10^{-2}$ Pa or less and then thermally treated at about 1,050° C. for approximately 1 hour, approximately 24 hours and approximately 120 hours, respectively. The resultant cast alloys will be referred to herein as "Samples (f), (g) and (h)", respectively.

[Evaluation]

The crystal structures of the respective samples were evaluated by an X-ray diffraction (XRD) analysis. The XRD analysis was carried out on powders that had been obtained by pulverizing the respective samples to a size of about 150 μm or less. In the XRD analysis, Cu was used as a target, the scan speed was about 4.0 degrees per minute, the sampling width was about 0.02 degrees and the measuring range was about 20 degrees to about 80 degrees.

The heat treatment conditions of the resultant Samples (a) through (h) and the phases that were produced in the respective alloys are shown in the following Table 1:

TABLE 1

| Sample | Heat treatment conditions | | | Produced phases | | |
|---|---|---|---|---|---|---|
| (a) | — | — | — | $LaFe_{13}$ | ◎ α-Fe | (La, Fe, Si) |
| (b) | 1,000° C. | 1 hr | 10 Pa | ◎ $LaFe_{13}$ | α-Fe | — |
| (c) | 1,050° C. | 24 hrs | $10^{-2}$ Pa | ◎ $LaFe_{13}$ | α-Fe | — |
| (d) | 1,050° C. | 120 hrs | $10^{-2}$ Pa | ◎ $LaFe_{13}$ | α-Fe | — |
| (e) | — | — | — | — | ◎ α-Fe | (La, Fe, Si) |
| (f) | 1,050° C. | 1 hr | $10^{-2}$ Pa | $LaFe_{13}$ | ◎ α-Fe | (La, Fe, Si) |
| (g) | 1,050° C. | 24 hrs | $10^{-2}$ Pa | ◎ $LaFe_{13}$ | α-Fe | (La, Fe, Si) |
| (h) | 1,050° C. | 120 hrs | $10^{-2}$ Pa | ◎ $LaFe_{13}$ | α-Fe | — |

In Table 1, phases with ◎ are represented by main peaks in an XRD chart.

The modes and composition distributions of the respective samples were evaluated with an electron probe microanalyzer (EPMA) The samples to be observed with the EPMA were obtained in the following manner. Specifically, the respective sample alloys were impregnated with an epoxy resin, had their surfaces polished, and then coated with Au to a thickness of about 20 nm by an evaporation process. The EPMA was used with an acceleration voltage of about 15 kV applied. A beam current of about 1.0 nA was supplied in backscattered electron image (BEI) scanning.

The magnetic properties (or magnetocaloric effects) of the respective samples were evaluated. A magnetic refrigerant material preferably exhibits as great a magnetocaloric effect as possible. The magnetocaloric effect is normally evaluated by the magnetic entropy change $-\Delta S_{mag}$. Generally speaking, the greater the magnetic entropy change $-\Delta S_{mag}$, the more significant the magnetocaloric effect. The magnetization (M)-temperature (T) curve of each sample was obtained with a magnetic field having a constant strength applied thereto. Using a high-field vibrating sample magnetometer (VSM), the field strength was changed from about 0 T to about 1 T at regular intervals of about 0.2 T. Based on the results of measurement, the magnetic entropy change $-\Delta S_{mag}$ was calculated by the following Equation (1):

$$-\Delta S_{mag} = \int_0^H (\partial M/\partial T)_H dH \quad (1)$$

where $\Delta S_{mag}$ is the magnetic entropy change, H is the magnetic field, M is the magnetization and T is the absolute temperature.

Figure 2:
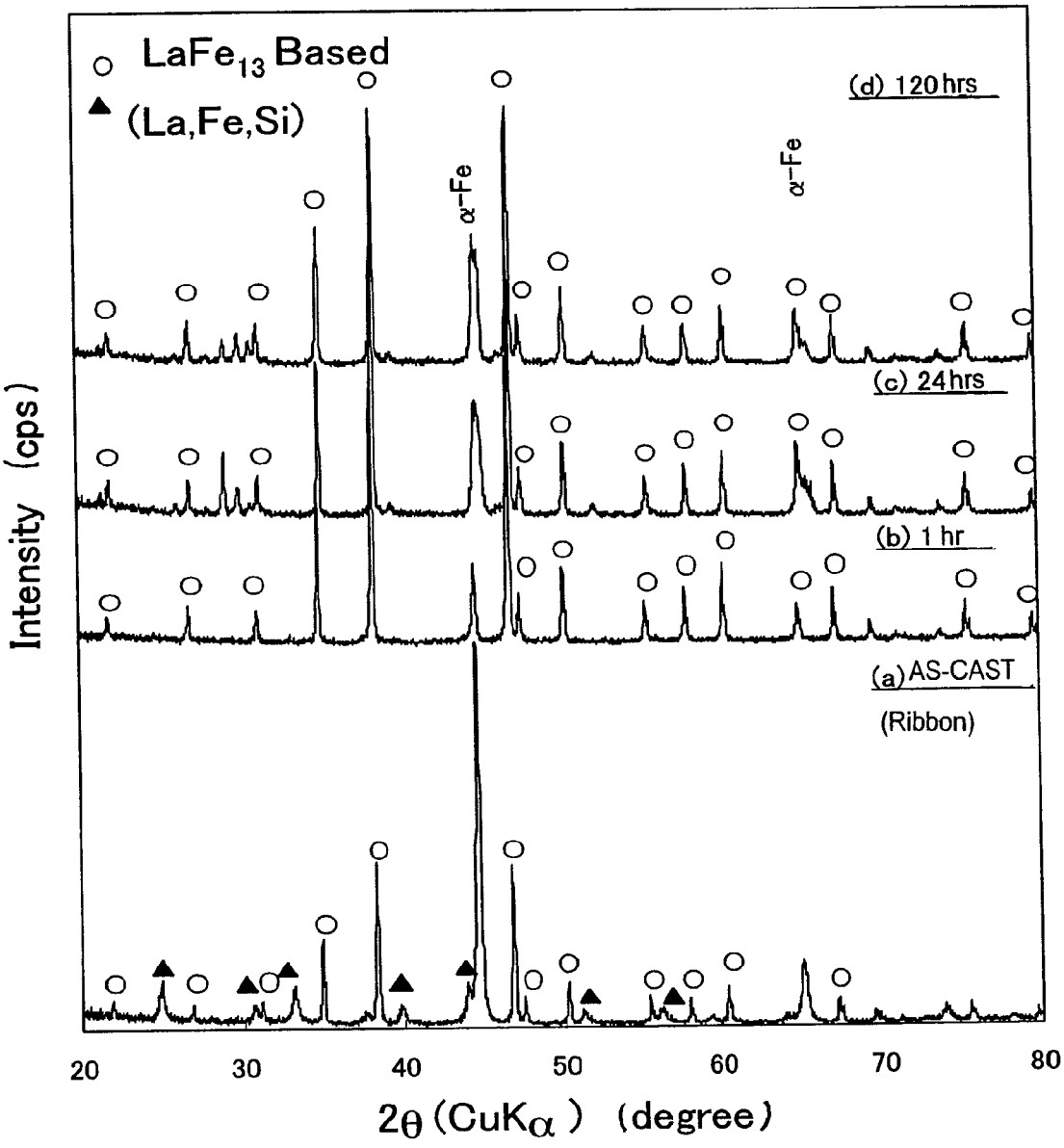
FIG. 2 is a graph showing the results of an XRD analysis that was carried out on Samples (a), (b), (c) and (d) obtained from the rapidly solidified alloys.
Figure 3:
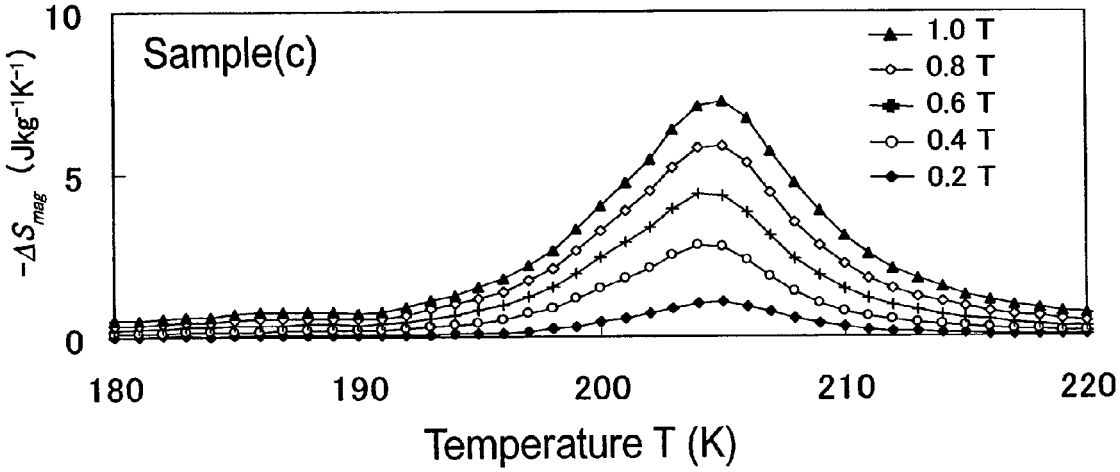
FIG. 3 is a graph showing how the magnetic entropy change $-\Delta S_{mag}$ of Sample (c) varied with the temperature.
Figure 4:
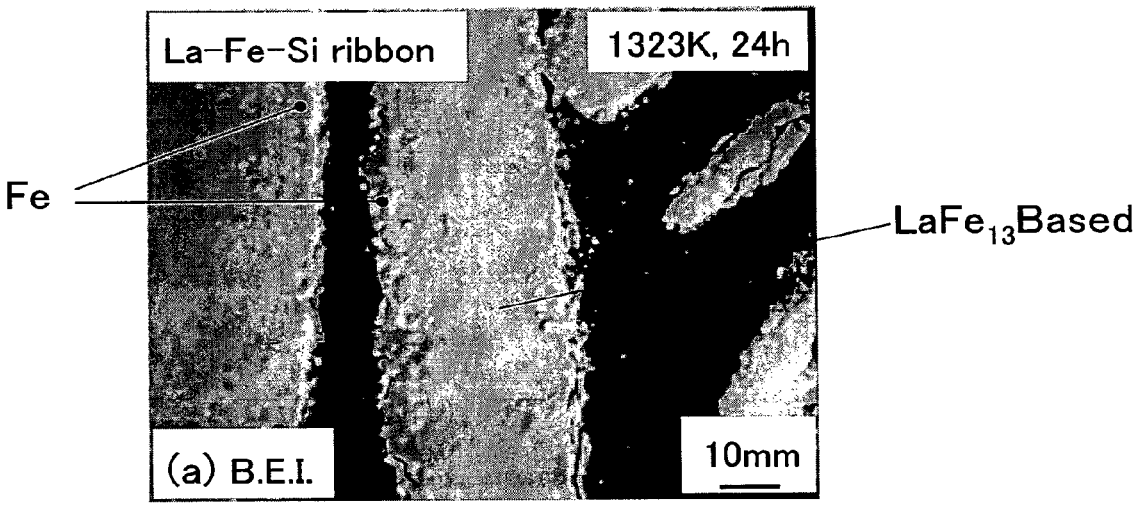
FIG. 4 is a micrograph showing a backscattered electron image (BEI) that was obtained by analyzing Sample (c) with an electron probe microanalyzer (EPMA).

FIG. 2 shows the results of an XRD analysis that was carried out on Samples (a), (b), (c) and (d) obtained from the rapidly solidified alloys. FIG. 3 shows how the magnetic entropy change $-\Delta S_{mag}$ of Sample (c) varied with the temperature. FIG. 4 shows a BEI that was obtained by analyzing Sample (c) with the EPMA.

Figure 5:
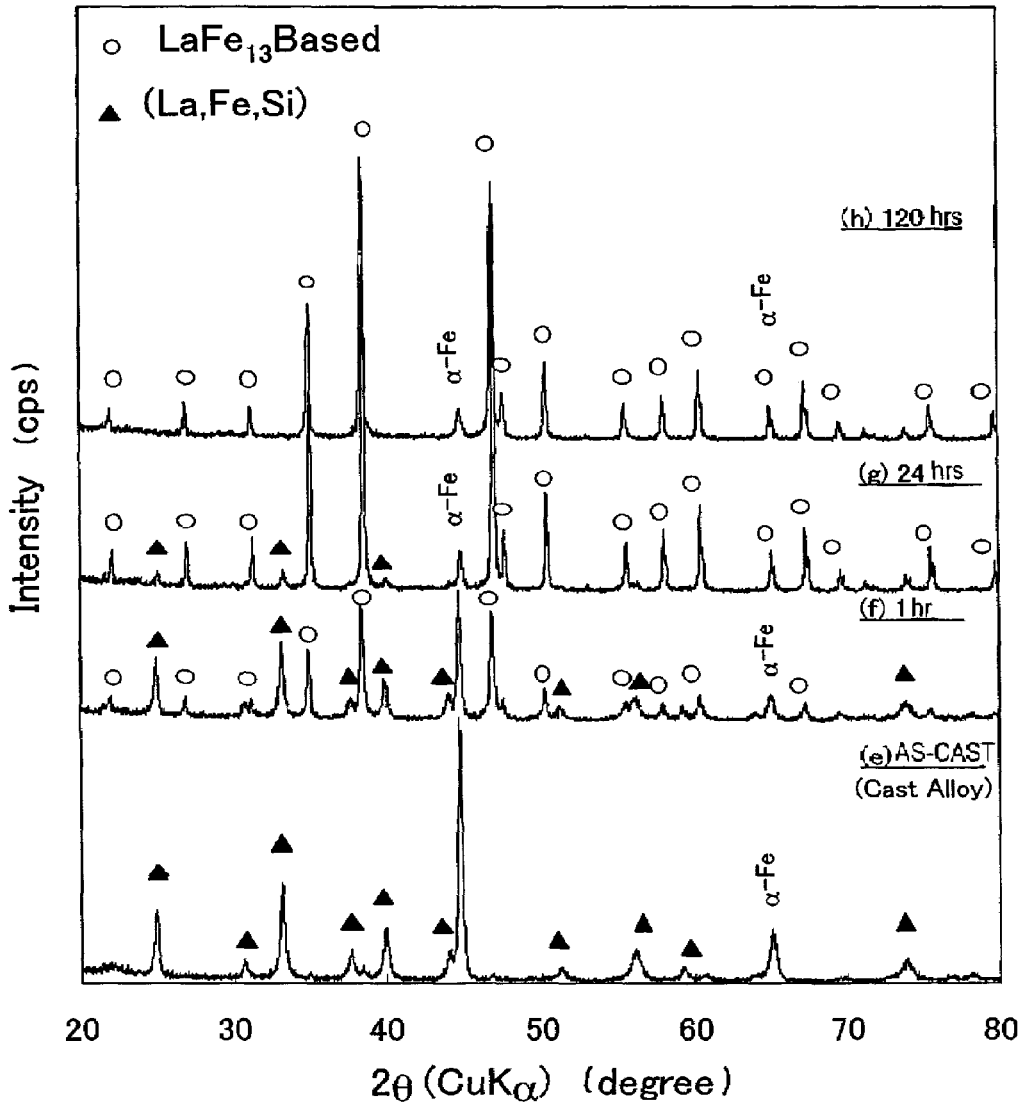
FIG. 5 is a graph showing the results of an XRD analysis that was carried out on Samples (e), (f), (g) and (h) obtained from cast alloys.
Figure 6A:
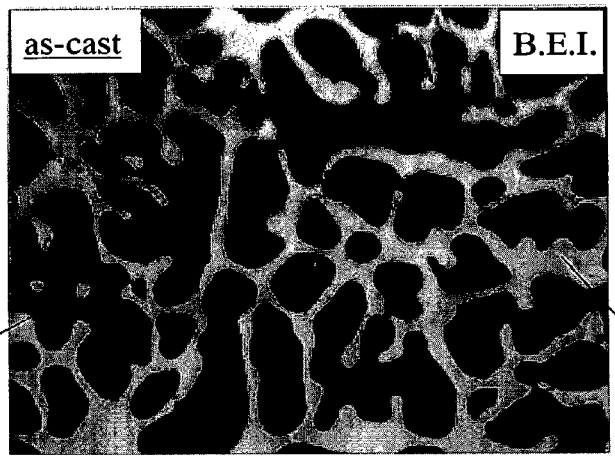
FIGS. 6A, 6B and 6C are micrographs showing BEIs that were obtained by analyzing the comparative samples (made of the cast alloys) with the EPMA.
Figure 6B:
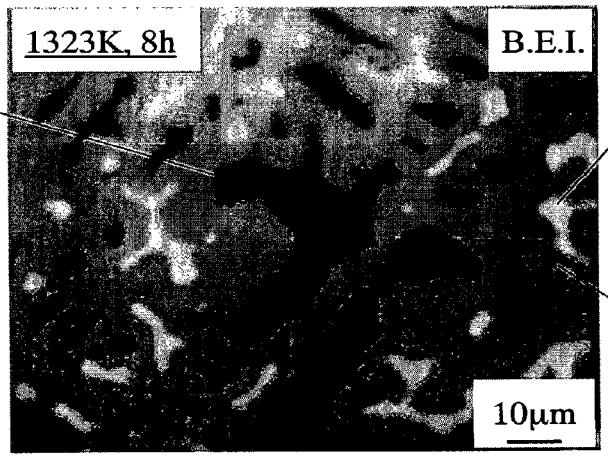
Figure 6C:
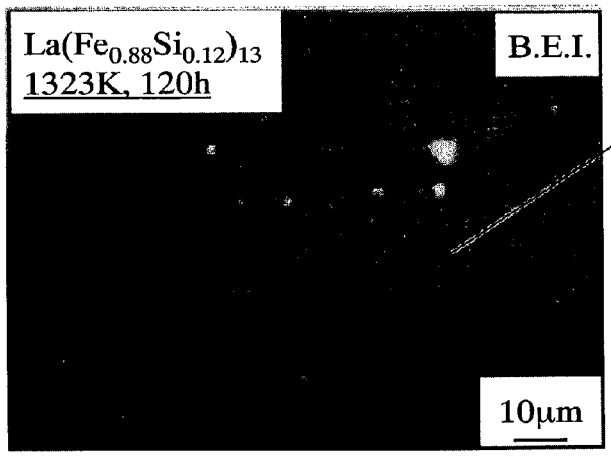

For the purpose of comparison, FIG. 5 shows the results of an XRD analysis that was carried out on Samples (e), (f), (g) and (h) obtained from the cast alloys. FIGS. 6A and 6C show BEIs that were obtained by analyzing Samples (e) and (h) with the EPMA. FIG. 6B shows a BEI of a sample that was thermally treated for approximately 8 hours.

Hereinafter, the difference in structure between the rapidly solidified alloy samples according to specific examples of preferred embodiments of the present invention and the conventional cast alloy samples will be described with reference to FIGS. 2 and 5.

As can be seen from FIG. 2, even the as-cast alloy (i.e., Sample (a)), as well as all the other samples representing specific examples of preferred embodiments of the present invention, included an $LaFe_{13}$-type compound phase as indicated by the open circles ○. It should be noted that Sample (a) also included an (La, Fe, Si) compound phase consisting of La, Fe and Si as indicated by the solid triangles ▲ and an α-Fe phase. However, Sample (b), obtained by thermally treating Sample (a) for approximately one hour, included almost no (La, Fe, Si) compound phase and significantly decreased α-Fe phase. Thereafter, even if the heat treatment process was carried out for an extended period of time, almost no variations were observed except that the peaks representing the α-Fe phase increased their intensities to a certain degree. Thus, it can be seen that in this case, the rapidly solidified alloy turned into the $LaFe_{13}$-type compound phase almost entirely by being thermally treated for approximately one hour. Also, take a look at the BEI of Sample (c) shown in FIG. 4, and it can be seen that almost the entire thin strip had a substantially uniform composition distribution except that a lot of Fe was present around the ends of the thin strip.

Furthermore, as can be seen from the temperature dependence of the magnetic entropy change $-\Delta S_{mag}$ as shown in FIG. 3, Sample (c) (i.e., a rapidly solidified alloy representing a specific example of a preferred embodiment of the present invention) showed great magnetic entropy changes. Specifically, $-\Delta S_{mag}$ between about 0 T and about 1 T measured about 7.5 $Jkg^{-1} K^{-1}$. Gadolinium (Gd), which is often used in a currently available magnetic refrigeration tester operating at around room temperature, shows $-\Delta S_{mag}$ of about 3 $Jkg^{-1} K^{-1}$ between about 0 T and about 1 T. Thus, it can be seen that this rapidly solidified alloy shows a greater magnetic entropy change $-\Delta S_{mag}$ than Gd. Having had its surface oxide layer (with a thickness of about 2 mm) removed, Sample (h), obtained from a cast alloy, showed $-\Delta S_{mag}$ of about 19 $Jkg^{-1} K^{-1}$ Sample (c) showed a lower $-\Delta S_{mag}$ than Sample (h) probably due to the presence of the surface oxide layer. However, considering the industrial applicability, this decrease in $-\Delta S_{mag}$ is much less significant than various effects of the present invention to be achieved by shortening the heat treatment time, cutting down the material cost, and simplifying the pulverization process. As also can be seen from FIG. 3, the temperature range in which Sample (c) exhibits the magnetic phase transition has a half width Δ Tc of about 30 K or more, thus ensuring a broad operating temperature range as a magnetic refrigerant material.

On the other hand, as can be seen from the results of the XRD analysis that was carried out on Samples (e) through (h), obtained from the conventional cast alloy, as shown in FIG. 5 and from the BEIs shown in FIGS. 6A through 6C, the as-cast alloy (i.e., Sample (e)) included no $LaFe_{13}$-type compound phase, but the alloy being thermally treated gradually lost the (La, Fe, Si) compound phase and α-Fe phase and gradually gained the $LaFe_{13}$-type compound phase. Also, comparing the results shown in FIG. 2 with those shown in FIG. 5, it can be seen that Sample (b), obtained by thermally treating the as-cast rapidly solidified alloy for approximately one hour, included almost no (La, Fe, Si) compound phase, while Sample (g), obtained by thermally treating the conventional cast alloy for approximately 24 hours, still included some (La, Fe, Si) compound phase.

Thus, by thermally treating the rapidly solidified alloy for just a short period of time, an $LaFe_{13}$-based magnetic alloy, including the $LaFe_{13}$-type compound phase as a main phase, can be obtained.

The present inventors carried out experiments to find the best heat treatment time. The results will be described below.

EXPERIMENTAL EXAMPLE NO. 2

[Making Samples]

As in Experimental Example No. 1 described above, respective materials La, Fe and Si in predetermined amounts were mixed together such that an $LaFe_{13}$-type compound phase having a composition $La(Fe_{0.88}Si_{0.12})_{13}$ could be obtained. Then, the mixture was melted in a high frequency melting crucible, thereby obtaining a cast alloy. Thereafter, a melt of about 10 g of the resultant ingot cast alloy was ejected through a quartz nozzle with a diameter of about 0.8 mm onto a Cu roller that was rotating at a velocity of about 20 m/s, thereby obtaining an alloy ribbon as Sample (i).

Subsequently, Sample (i) was thermally treated at about 1,050° C. within an Ar atmosphere for approximately 1 minute, approximately 5 minutes, approximately 10 minutes, approximately 30 minutes and approximately 60 minutes. The alloy ribbons obtained in this manner will be referred to herein as "Samples (j), (k), (1), (m) and (n)", respectively.

Also, five more cast alloys, having compositions represented by $La(Fe_{1-x}Si_x)_{13}$ (where x=0.10, 0.11, 0.12, 0.13, and 0.14), were prepared by the method described above. Then, the respective cast alloys were processed into alloy ribbons by the rapid cooling process described above. In this process, however, the Cu roller was rotated at a velocity of about 10 m/s.

Subsequently, the resultant alloy ribbons were wrapped in Nb foils and thermally treated at about 1,050° C. within an Ar atmosphere for approximately 1 hour. The alloy ribbons obtained in this manner will be referred to herein as "Samples (o), (p), (q), (r) and (s)", respectively.

For the purpose of comparison, about 10 g of each of the cast alloys was introduced airtight into a quartz tube that had been evacuated to a vacuum of about $10^{-2}$ Pa or less and then thermally treated at about 1,050° C. for approximately 120 hours. The resultant cast alloys will be referred to herein as "Samples (t), (u), (v), (w) and (x)", respectively.

The compositions and processing conditions of Samples (i) through (s), representing specific examples of preferred embodiments of the present invention, and Samples (t) through (x), representing comparative examples, are shown in the following

TABLE 2

| Sample | Composition (at %) | Quenching condition Roller velocity | Heat treatment conditions Temperature/atmosphere/time |
|---|---|---|---|
| (i) | $La(Fe_{0.88}Si_{0.12})_{13}$ | 20 m/s | — |
| (j) | $La(Fe_{0.88}Si_{0.12})_{13}$ | 20 m/s | 1,050° C./Ar gas/1 min |
| (k) | $La(Fe_{0.88}Si_{0.12})_{13}$ | 20 m/s | 1,050° C./Ar gas/5 min |
| (l) | $La(Fe_{0.88}Si_{0.12})_{13}$ | 20 m/s | 1,050° C./Ar gas/10 min |
| (m) | $La(Fe_{0.88}Si_{0.12})_{13}$ | 20 m/s | 1,050° C./Ar gas/30 min |
| (n) | $La(Fe_{0.88}Si_{0.12})_{13}$ | 20 m/s | 1,050° C./Ar gas/1 hr |
| (o) | $La(Fe_{0.90}Si_{0.10})_{13}$ | 10 m/s | 1,050° C./Ar gas/1 hr |
| (p) | $La(Fe_{0.89}Si_{0.11})_{13}$ | 10 m/s | 1,050° C./Ar gas/1 hr |
| (q) | $La(Fe_{0.88}Si_{0.12})_{13}$ | 10 m/s | 1,050° C./Ar gas/1 hr |
| (r) | $La(Fe_{0.87}Si_{0.13})_{13}$ | 10 m/s | 1,050° C./Ar gas/1 hr |
| (s) | $La(Fe_{0.86}Si_{0.14})_{13}$ | 10 m/s | 1,050° C./Ar gas/1 hr |
| (t) | $La(Fe_{0.90}Si_{0.10})_{13}$ | — | 1,050° C./ vacuum(<$10^{-2}$ Pa)/120 hrs |
| (u) | $La(Fe_{0.89}Si_{0.11})_{13}$ | — | 1,050° C./ vacuum(<$10^{-2}$ Pa)/120 hrs |
| (v) | $La(Fe_{0.88}Si_{0.12})_{13}$ | — | 1,050° C./ vacuum(<$10^{-2}$ Pa)/120 hrs |
| (w) | $La(Fe_{0.87}Si_{0.13})_{13}$ | — | 1,050° C./ vacuum(<$10^{-2}$ Pa)/120 hrs |

TABLE 2-continued

| Sample | Composition (at %) | Quenching condition Roller velocity | Heat treatment conditions Temperature/atmosphere/time |
|---|---|---|---|
| (x) | $La(Fe_{0.86}Si_{0.14})_{13}$ | — | 1,050° C./ vacuum(<$10^{-2}$ Pa)/120 hrs |

[Evaluation]

Figure 7:
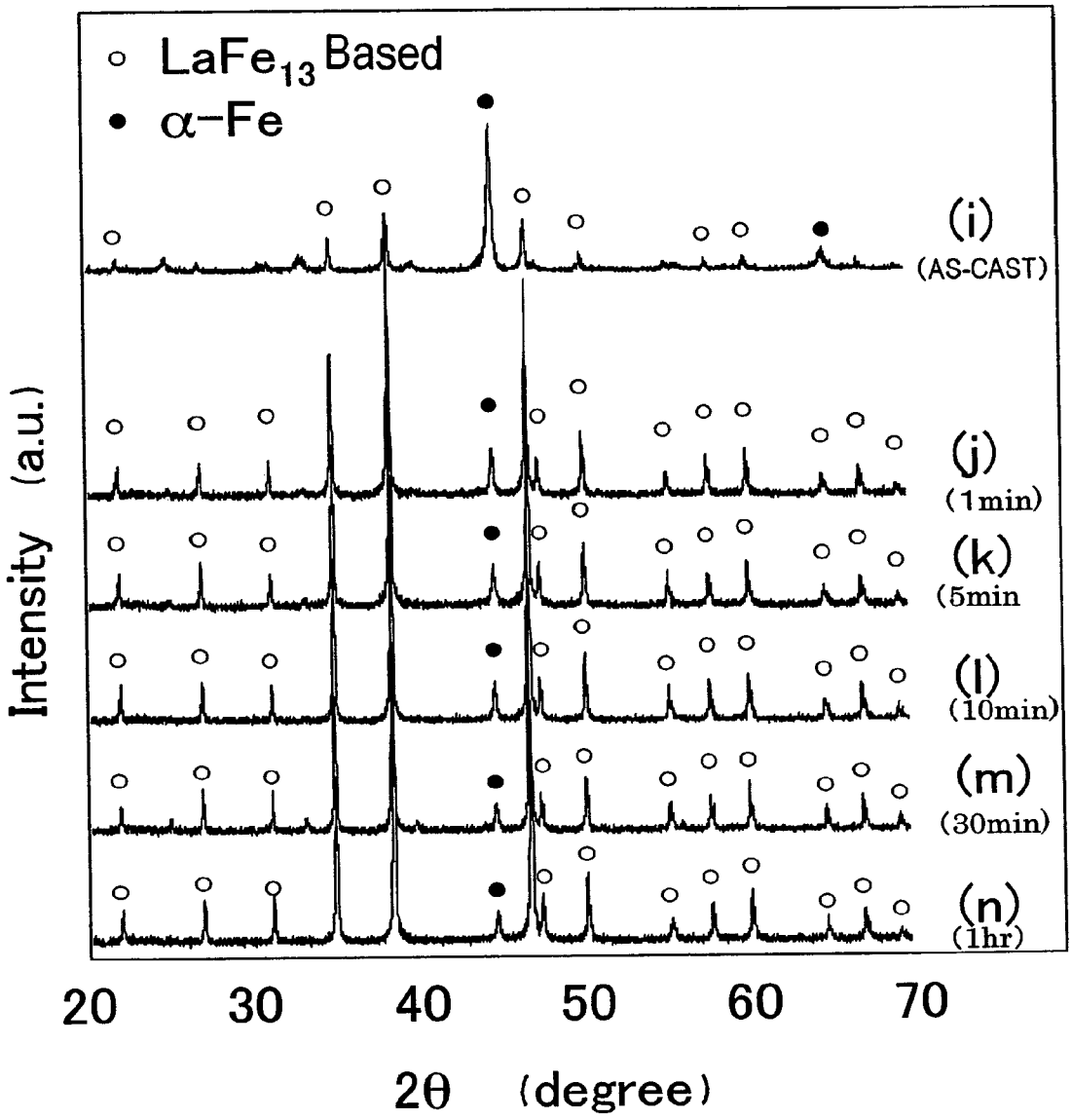
FIG. 7 is a graph showing the results of an XRD analysis that was carried out on Samples (i), (j), (k), (l), (m) and (n) obtained from the rapidly solidified alloys.

The respective samples were evaluated as in Experimental example No. 1 described above. FIG. 7 shows the results of an XRD analysis that was carried out to evaluate the crystal structures of Samples (i), (j), (k), (l), (m) and (n).

As is clear from the results shown in FIG. 7, by thermally treating the as-cast alloy ribbon (i.e., Sample (i)) for only about one minute, the resultant Sample (j) also had a decreased α-Fe phase. Thus, it is believed that the $LaFe_{13}$-type compound phase can still be increased effectively even by thermally treating the as-cast rapidly solidified alloy for just a short period of time (e.g., only one second).

Even if the heat treatment time was further extended, the intensities of diffraction peaks, representing the α-Fe phase, did not change until the heat treatment time reached approximately one hour (Sample (n)). However, as already described with reference to FIG. 2, when the heat treatment time reached approximately 24 hours (Sample (c)), the volume of the α-Fe phase rather increased. Judging from the heat treatment time dependence of the intensities of diffraction peaks representing the α-Fe phase, it is believed that the volume of the α-Fe phase did not increase until the heat treatment time reached approximately one hour. That is to say, the best heat treatment time for the rapidly solidified alloy was approximately one hour or less.

Figure 8A:
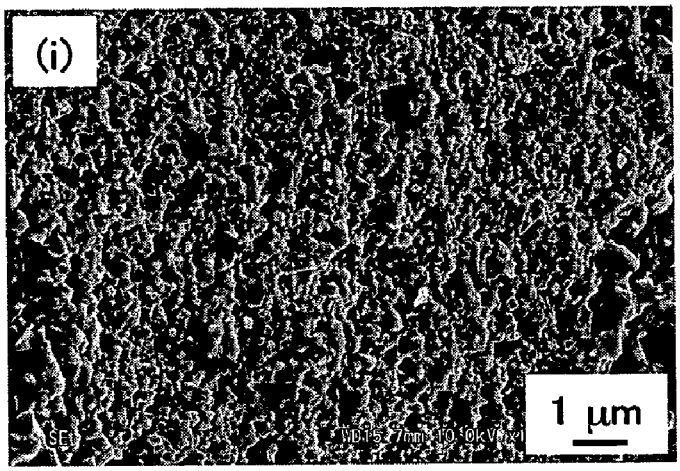
FIGS. 8A, 8B and 8C are micrographs showing the fracture structures of Samples (i), (k) and (n) that were observed with a field emission scanning electron microscope (FESEM).
Figure 8B:
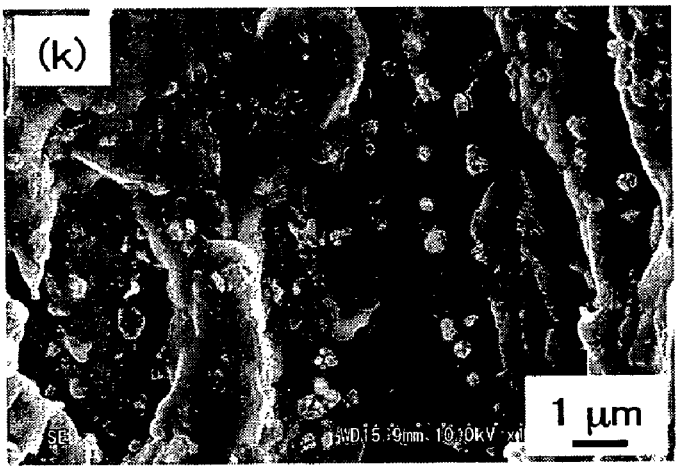
Figure 8C:
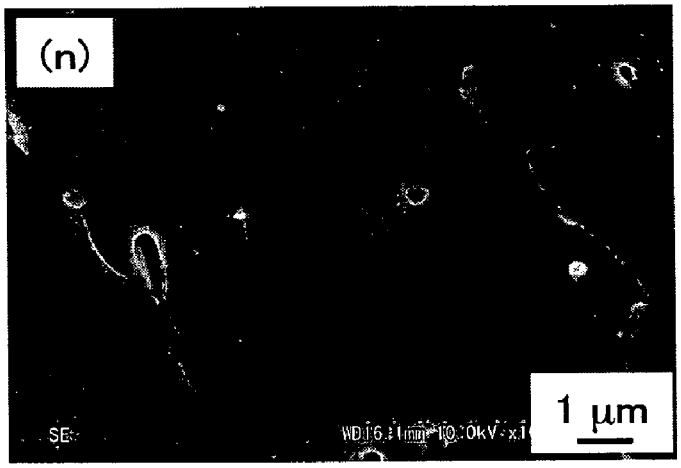

FIGS. 8A, 8B and 8C are micrographs showing fractures of Samples (i), (k) and (n), respectively, which were observed with a field emission scanning electron microscope (FESEM).

As can be seen from FIG. 8A, fine particulate structures with sizes of about 1 μm or less were observed in the as-cast alloy ribbon (i.e., Sample (i)). On the other hand, Sample (k), obtained by thermally treating the as-cast alloy for approximately 5 minutes, had structures in which particles with relatively large sizes of about 1 μm were combined together as shown in FIG. 8B. When the heat treatment time was further extended to approximately one hour, the resultant Sample (n) had no such particulate structures but a homogeneous microstructure as shown in FIG. 8C.

In this manner, as the alloy ribbon is thermally treated, the alloy loses the α-Fe phase, gains the $LaFe_{13}$-type compound phase, and has its structure homogenized.

Figure 9A:
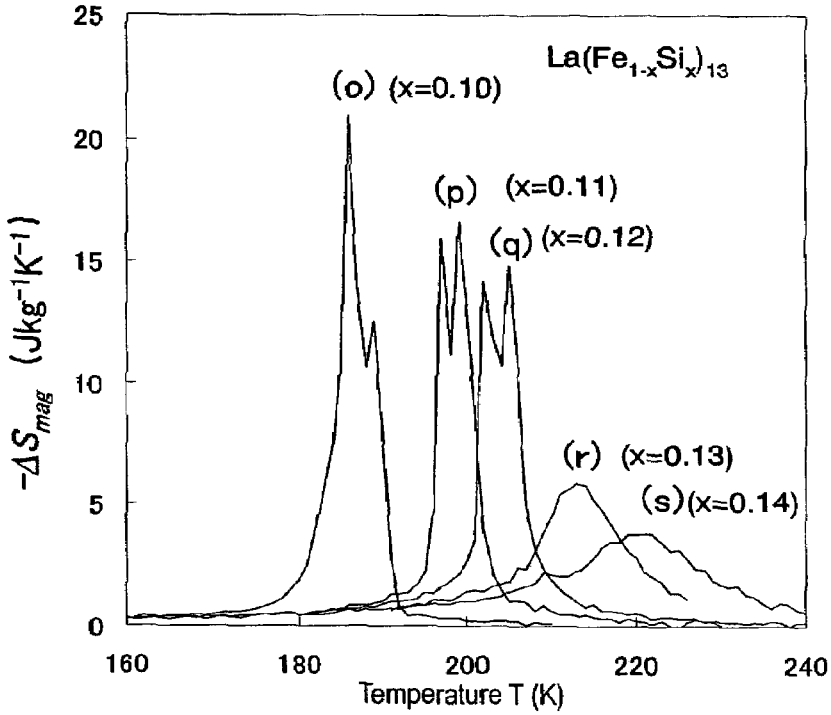
FIG. 9A is a graph showing the temperature dependences of $-\Delta S_{mag}$ for Samples (o), (p), (q), (r) and (s) that were obtained from alloy ribbons.
Figure 9B:
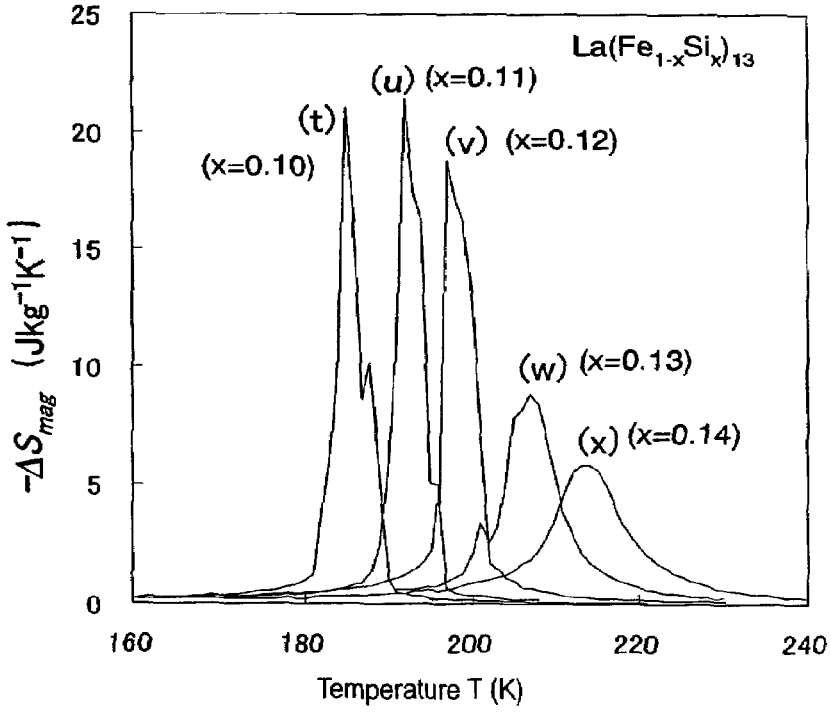
FIG. 9B is a graph showing the temperature dependences of $-\Delta S_{mag}$ for Samples (t), (u), (v), (w) and (x) that were obtained from cast alloys.

FIG. 9A shows the magnetic properties (or magnetocaloric effects) that were evaluated for Samples (o), (p), (q), (r) and (s) representing specific examples of preferred embodiments of the present invention. FIG. 9B shows the magnetic properties (or magnetocaloric effects) that were evaluated for Samples (t), (u), (v), (w) and (x) representing comparative examples.

Comparing the temperature dependence of the magnetic entropy change $-\Delta S_{mag}$ of each sample representing a specific example of a preferred embodiment of the present invention with that of the magnetic entropy change $-\Delta S_{mag}$ of its associated sample representing a comparative example, it can be seen that the temperature dependences were substantially equal to each other. Specifically, when the temperature was about 205 K or less, the maximum $-\Delta S_{mag}$ values of both samples were in the range of about 15 $Jkg^{-1} K^{-1}$ to about 21 $Jkg^{-1} K^{-1}$. However, once the temperature exceeded about 205 K, the maximum $-\Delta S_{mag}$ values of both samples were about 9 $Jkg^{-1} K^{-1}$ or less. That is to say, according to each specific example of a preferred embodiment of the present invention, when the rapidly solidified alloy was thermally treated for just about 1 hour, the magnetic entropy change $-\Delta S_{mag}$ of the resultant $LaFe_{13}$-based magnetic alloy material depended on the heat treatment temperature just like a magnetic alloy obtained by thermally treating the conventional cast alloy for approximately 120 hours.

According to various preferred embodiments of the present invention described above, an $LaFe_{13}$-based magnetic alloy material can be obtained at a much higher productivity than the conventional process. Thus, a magnetic refrigerant material and a magnetostrictive material can be provided at significantly lower costs than the conventional process. Also, a magnetic refrigerator can also be provided at a reasonable cost. The magnetic refrigerator is environmentally friendly because no gaseous refrigerant is used unlike a compression refrigerator. Also, by using a permanent magnet material additionally, the magnetic refrigerator achieves high energy conversion efficiency.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A rapidly solidified magnetic alloy made by a method comprising the steps of:

preparing a melt of an alloy material having a predetermined composition;

rapidly cooling and solidifying the melt of the alloy material by a melt quenching process to immediately produce a rapidly solidified alloy that includes fine particulate structures with sizes of about 1 μm or less, includes a compound phase having a $NaZn_{13}$-type crystal structure, and has a composition represented by the general formula:

$$Fe_{100-a-b-c}RE_aA_bTM_c$$

where RE is at least one rare-earth element that is selected from the group consisting of La, Ce, Pr, Nd, Pm, Sm, Eu, Gd, Tb, Dy, Ho, Er and Tm and that includes at least about 90 at % of La; A is at least one element that is selected from the group consisting of Al, Si, Ga, Ge and Sn; TM is at least one transition metal element that is selected from the group consisting of Sc, Ti, V, Cr, Mn, Co, Ni, Cu and Zn; and mole fractions a, b and c satisfy 5 at %≦a≦10 at %, 4.7 at %≦b≦18 at % and 0 at %≦c≦9 at %, respectively; wherein the rapidly solidified magnetic alloy has not been subjected to thermal treating.

2. The magnetic alloy material of claim 1, wherein the step of rapidly cooling and solidifying the melt includes the step of rapidly cooling and solidifying the melt at a cooling rate of about $1\times10^{2}$° C./s to about $1\times10^{8}$° C./s.

3. The magnetic alloy material of claim 1, wherein the step of rapidly cooling and solidifying the melt produces a thin-strip rapidly solidified alloy having a thickness of about 10 μm to about 300 μm.

* * * * *